US006425228B2

(12) United States Patent
Lancaster, III et al.

(10) Patent No.: US 6,425,228 B2
(45) Date of Patent: Jul. 30, 2002

(54) METHOD AND APPARATUS FOR WRAPPING A LOAD

(75) Inventors: Patrick R. Lancaster, III; Steve Hack, both of Louisville, KY (US); Steven DeGrasse, New Albany, IN (US); Don Norris, Pleasureville, KY (US)

(73) Assignees: Lantech Manangement Corp.; Lantech Holding Corp., both of Louisville, KY (US)

( * ) Notice: Subject to any disclaimer, the term of this patent is extended or adjusted under 35 U.S.C. 154(b) by 0 days.

(21) Appl. No.: 09/910,075

(22) Filed: Jul. 23, 2001

Related U.S. Application Data

(62) Division of application No. 09/434,941, filed on Nov. 5, 1999, now Pat. No. 6,289,652.
(60) Provisional application No. 60/107,283, filed on Nov. 6, 1998.

(51) Int. Cl.[7] ..... B65B 11/00; B65B 11/56
(52) U.S. Cl. ..... 53/588; 53/176; 53/210; 53/399; 53/441; 53/587
(58) Field of Search ..... 53/176, 210, 399, 53/441, 449, 587, 588

(56) References Cited

U.S. PATENT DOCUMENTS 4,079,565 A * 3/1978 Lancaster, III et al. ..... 53/3
4,109,445 A 8/1978 Shulman
4,299,076 A * 11/1981 Humphrey ..... 53/587
4,317,322 A * 3/1982 Lancaster et al. ..... 53/399
4,413,463 A * 11/1983 Lancaster ..... 53/553
4,553,374 A * 11/1985 Lancaster et al. ..... 53/556
4,658,570 A 4/1987 Thomas
4,711,069 A * 12/1987 Silbernagel ..... 53/556
4,979,358 A 12/1990 Keip
5,027,579 A 7/1991 Keip
5,184,449 A 2/1993 Hannen
5,195,297 A 3/1993 Lancaster et al.
5,421,141 A 6/1995 Gordon

* cited by examiner

*Primary Examiner*—John Sipos
*Assistant Examiner*—Hemant M Desai
(74) *Attorney, Agent, or Firm*—Finnegan, Henderson, Farabow, Garrett & Dunner, L.L.P.

(57) ABSTRACT

A non-powered packaging material transporting surface for use in combination with a load support surface of a wrapping apparatus for wrapping a top and bottom of a load is provided. The non-powered packaging material transporting surface includes non-driven rollers aligned in an inline configuration, and a packaging material support guard adjacent to the non-driven rollers. The packaging material support guard bridges gaps between the inline rollers, thereby preventing capture of packaging material between the non-driven rollers. The non-driven rollers rotate as packaging material, wrapped around a load on a top surface of the load support surface and around the non-powered packaging material transporting surface on the underside surface of the load support surface, is moved along the transporting surface.

23 Claims, 12 Drawing Sheets

METHOD AND APPARATUS FOR WRAPPING A LOAD

This is a Division of parent application Ser. No. 09/434,941, now U.S. Pat. No. 6,249,652 filed Nov. 5, 1999. The contents of this parent application being relied upon and incorporated by reference herein.

This application claims the benefit of U.S. provisional application No. 60/107,283, filed Nov. 6, 1998, which is incorporated herein by reference.

BACKGROUND OF THE INVENTION

1. Field of the Invention

The invention relates to wrapping a load with packaging material, and, more particularly, to stretch wrapping.

2. Description of the Related Art

Various packaging techniques have been used to build a load of unit products and subsequently wrap them for transportation, storage, containment and stabilization, protection and waterproofing. One system uses stretch wrapping machines to stretch, dispense and wrap stretch packaging material around a load. Stretch wrapping can be performed as an inline, automated packaging technique which dispenses and wraps packaging material in a stretch condition around a load on a pallet to cover and contain the load. Pallet stretch wrapping, whether accomplished by a turntable, rotating arm, or rotating ring typically covers the four vertical sides of the load with a stretchable film such as polyethylene film. In each of these arrangements, relative rotation is provided between the load and the packaging material dispenser to wrap packaging material about the sides of the load.

Wrapping packaging material about the sides of the loads typically unitizes and stabilizes the load. However, such side wrapping generally does not cover the top of the load or secure the load to the pallet in the manner which would promote increased stability. Because of the structure of a typical stretch wrap apparatus, it is difficult to wrap packaging material about the top and bottom of the load to secure the load to the pallet for stability. Previous attempts to wrap packaging material about the top and bottom of a load include holding a palletized load on the tines of a forklift truck and placing the load and tines supporting the load within a wrapping mechanism to be wrapped. This method requires the driver of the forklift truck to carefully control the timing and position of the truck and the wrapping machinery revolving around the load and tines of the forklift truck to wrap packaging material about the top and bottom of the load to avoid undesirable interference between the truck, the load and the wrapping machinery during wrapping. Alternatively, the top and bottom of the load have been wrapped by conveying a load through a wrapping ring on a dual conveying mechanism such that after wrapping, the load is wrapped to the conveyor and the dual conveyor must move the load and the packaging material away from the wrapping area together. Such devices are expensive, requiring structure to keep the load and the packaging material moving at the same speed along the conveyor, preventing the packaging material from being caught on or torn, and arrangements to get electrical power to the rotating portion of the ring for controlling a dispenser mounted on the ring. In another alternative, a load is positioned and wrapped on a cantilevered load support having a free end in the wrapping area such that a cantilevered packaging material dispenser is rotated about the load on the cantilevered load support below the free end of the cantilevered load support. Thus, the load is wrapped to the cantilevered load support and then the load must be pushed off or carried off of the load support by the following load or taken off with a conveyor. However, there is a high degree of friction involved with such movement off of the load support which may cause disorientation of the load or the film.

Over the past fifteen years many machine developers have struggled with conveying packaging material off the base of the load support and off of conveying systems. The problem is complicated by characteristics of stretched packaging material being pulled transversely from the direction that has been stretched wrapped around a load. The wrapped force may range up to 800 pounds for a 48-inch long load.

Additionally, the packaging material is typically spirally wrapped and made up of up to 40 individual wraps. Due to the nature of the spiral, some packaging materials develop ropes along their edges. The packaging material is designed to bond to itself and therefore is quite tacky. These characteristics make it difficult to slide the packaging material over any fixed surface where significant forces are incurred. Several approaches have been disclosed to drive the packaging material on a conveying means parallel to the direction of the travel of the load. These include patents issued to Lantech Inc. and to Keip Machine Co. These systems depend on relatively expensive and complex drive mechanisms to drive the packaging material independently of the force of the load.

Due to the expensive nature of the independent drives required to drive the packaging material and the load, other attempts have been made to use non-powered mechanisms to carry the packaging material. Such attempts include the use of rollers, belts, chains, low friction coatings, air bearings, slider bars, screws, reciprocating feet, and air jets for a non-powered packaging material carrier. Each of these has suffered difficulty in robustly allowing the transverse movement of the load to slide the packaging material off the load support conveyor or platform. High drag force can distort the load, split the packaging material or cause the load drive conveyor to slip. Particular problems with attempts to use rollers and wheels include offsetting the wheels which allows them to catch the loose packaging material, and allowing ropes of packaging material to become caught between the wheels and thus lock the wheels, preventing the packaging material from moving along the rollers. In a further attempt to create a non-powered device, side bars were added to the rollers to carry some of the force of the packaging material and prevent jamming of the rollers. However, the friction created between the packaging material and the bars was too great, preventing easy movement of the packaging material and causing tearing of the packaging material and sticking between the packaging material and side bars.

In light of the drawbacks associated with providing expensive powered conveyors which move the packaging material and the load at the same speed and the friction problems associated with simply pushing the load off of a load wrapping surface, there is a need to wrap the top and bottom of the load with packaging material in the simple, reliable and inexpensive manner which will also allow for the removal of the load from the wrapping surface without tearing, friction or expensive mechanisms to do so. The present invention solves the problem of the delicate balance between protecting the wheels from locking up and prevention of a high friction contact.

SUMMARY OF THE INVENTION

Accordingly, the present invention is directed to a method and apparatus for wrapping a load with packaging material which provides advantages over and obviates several problems associated with earlier methods and apparatus for wrapping a top and bottom of a load.

To achieve these and other advantages and in accordance with the purpose of the invention, as embodied and broadly described, the invention provides an apparatus for wrapping packaging material around a top and bottom of a load. The apparatus for wrapping packaging material around a top and bottom of a load includes a cantilevered packaging material dispenser with a free end extending from an arm rotatable about a generally horizontal axis to wrap packaging material around the top and bottom of the load, a cantilevered load support with a free end mounted and movable between a wrapping position and a load transfer position, and a packaging material transporting surface positioned below the cantilevered load support and comprising non-driven rollers aligned in an inline configuration.

According to another aspect of the present invention, a non-powered packaging material transporting surface for use in combination with a load support surface of a wrapping apparatus for wrapping a top and bottom of a load is provided. The packaging material transporting surface includes non-driven rollers aligned in an inline configuration, and a packaging material support guard adjacent to the non-driven rollers, the packaging material support guard bridging gaps between the inline rollers, thereby preventing capture of packaging material between the non-driven rollers, wherein the non-driven rollers rotate as packaging material, wrapped around a load on a top surface of the load support surface and around the non-powered packaging material transporting surface on the underside surface of the load support surface, is moved along the transporting surface.

According to one aspect of the present invention, method of wrapping a top and bottom of a load with packaging material is provided. The method includes positioning a load on a load support having an upper load support surface and a lower non-powered packaging material transporting surface including non-driven rollers in an inline configuration, dispensing packaging material from a packaging material dispenser and providing relative rotation between the dispenser and the load to wrap packaging material around the top and bottom of the load and over the non-powered packaging material transporting surface, and rotating the non-driven rollers of the non-powered packaging material transporting surface by moving the packaging material over the rollers as the load is removed from the upper load support surface.

Additional features and advantages of the invention will be set forth in the description which follows, and in part will be apparent from the description, or may be learned by practice of the invention. The objects and other advantages of the invention will be realized and attained by the method and apparatus particularly pointed out in the written description and claims as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute a part of the specification, illustrate an embodiment of the invention, and together with the description serve to explain the principles of the invention.

DETAILED DESCRIPTION OF THE PREFERRED EMBODIMENT

The present invention incorporates by reference U.S. Pat. Nos. 4,317,322, 4,979,358, and 5,027,579. The following text and accompanying drawings illustrate examples of the present preferred embodiments of the present invention. As used herein, the terms "packaging material" and "film" are interchangeable.

One aspect of the invention includes an apparatus provided for wrapping a top and bottom of a load with packaging material. As embodied and shown in FIGS. 3–5, the apparatus for wrapping a load with packaging material includes stretch wrapping apparatus 100.

The present invention includes a cantilevered load support 1 having a top load support surface la and a non-powered packaging material transporting surface lb. Packaging material transporting surface 1*b* includes non-driven rollers 2 mounted to an outer side of a rail 6 which is adjacent to and positioned below the load support surface 1*a*. Preferably two sets of inline rollers 2*a* and 2*b* are provided, one on either side of packaging material transporting surface 1*b*. These rollers are inline directly one behind the other to form two rows of non-driven rollers. Non-driven rollers 2 are preferably roller skate wheels, approximately two inches in diameter, aligned in an inline configuration. Other sizes or types of wheels may be used, however, currently preferred are roller skate wheels which are inexpensive, easy to find, of the appropriate size, and commonly used in carton conveyors. Alternatively, more than two rows of rollers may be used, or only a single row of rollers may be used.

Figure 1:
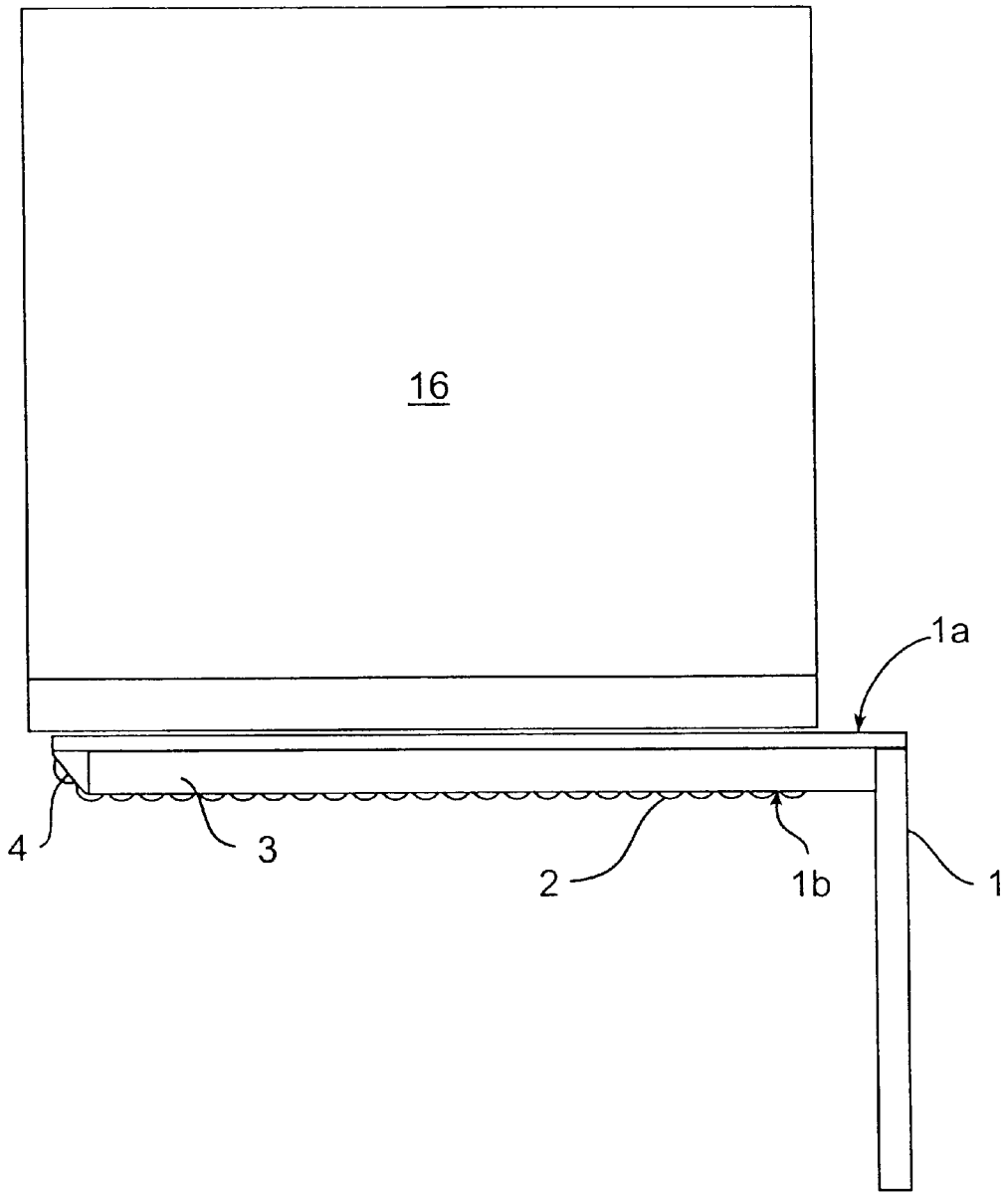
Fig.1 is a side view of an apparatus for wrapping a load according to a first embodiment of the present invention.

As shown in FIGS. 1 and 2, packaging material transporting surface 1*b* also includes a packaging material support guard 3 attached to cantilevered load support 1.

Packaging material support guard 3 is positioned on the outside exposed roller surfaces (the sides of the rollers not adjacent to rail 6) of non-driven rollers 2 so as to be located between the outside roller surfaces and the packaging material during wrapping. The packaging material support guard 3 covers between 75% and 95% of the outer roller surfaces which face the packaging material when packaging material has been wrapped around the load and load support surface. More preferably, packaging material support guard 3 covers between 88% and 94% of the outer roller surfaces. The portion of the roller surfaces not covered are the lowermost portions of the roller surfaces on which the package material will move. For example, in a roller having approximately a 2" diameter, the following ranges of covered roller surface versus non-covered roller surface might be used. For each ratio, the measurement of the amount of surface covered is taken from the top of the wheel adjacent the load bearing surface 1*a* towards the bottom of the wheel surface which will carry the packaging material. If the amount of surface covered is too small, the packaging material will still become caught between the rollers, preventing movement of the packaging material. Additionally, if the amount of surface covered is too large, there will be a large amount of friction between the packaging material support guard 3 and the packaging material, resulting in tearing of the film and prevention of movement of the film.

Preferred ranges include, for approximately 2" diameter wheels, 1 and ½" (75%) of the wheels covered by the packaging material support guard 3, and the lowermost ½" of the wheels uncovered; 1 and ¾" (approximately 88%) of the wheels covered by the packaging material support guard 3, and the lowermost ¼" of the wheels uncovered; and in a most preferred range, 1 and ⅞" (approximately 94%) of the wheels covered and the lowermost ⅛" of the wheels uncovered. These values, given for approximately 2" diameter wheels, can be converted to their respective percentages and applied to any given wheel size. Generally, it is preferred that between 75% and 95% of the outer surfaces of the wheels be covered, and between 25% and 5% of the lowermost portions of the wheels be uncovered. More preferably, between 88% and 94% of the outer surfaces of the wheels be covered, and between 12% and 6% of the lowermost portions of the wheels be uncovered.

Non-powered packaging material transporting surface 1*b* also includes non-powered rollers 4. Rollers 4 are located only on the free end of the load support surface and are placed to assist the packaging material to smoothly flow off of the packaging material transporting surface 1*b*. Rollers 4 are the "last" rollers, i.e., the rollers at the very end of the packaging material transporting surface 1*b*. Rollers 4 are laterally and/or vertically raised from the plane of the other non-driven rollers 2, and are offset inwardly from non-driven rollers 2, being attached to an inner side of rail 6. Rollers 4 are preferably angled outwardly from the bottom portion of load support 1. Preferably, the rollers are angled outwardly from the vertical 10 to 45 degrees.

Figure 2A:
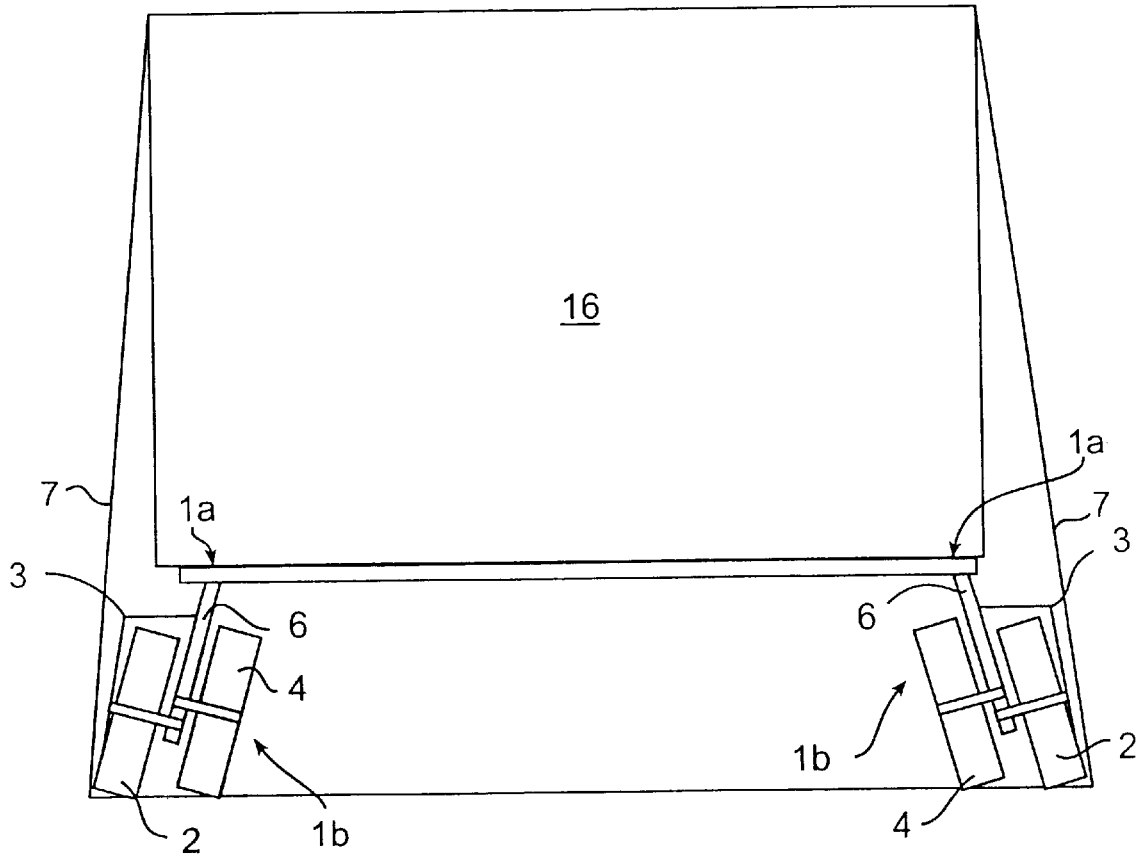
FIG. 2A is a front view of the apparatus of FIG. 1.
Figure 2B:
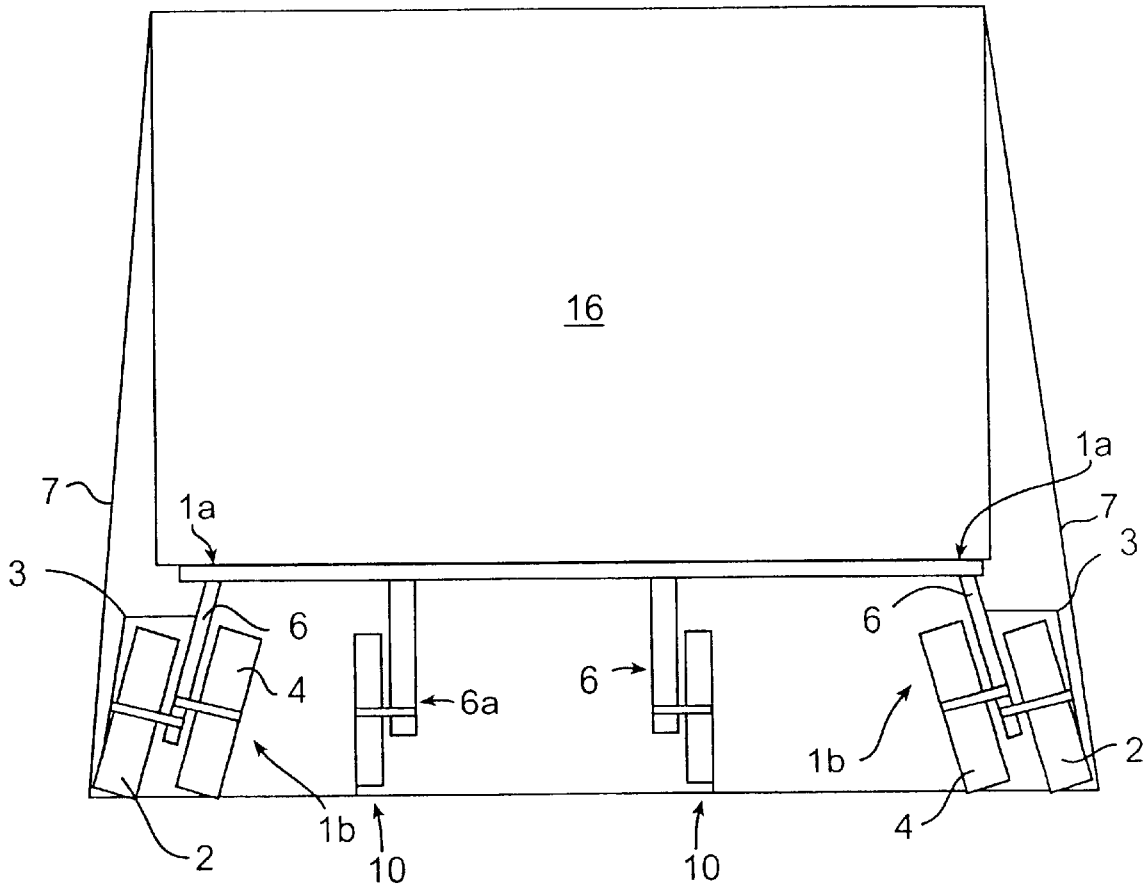
FIG. 2B is an alternative front view of the apparatus of FIG. 1.

As can be seen in FIG. 2A, non-driven rollers 2 are angled outwardly from the bottom portion of load support 1. Preferably, the non-driven rollers 2 are angled outwardly from the vertical 10 to 45 degrees. Alternatively, as seen in FIG. 2B, if more than two rows of rollers are provided, the outermost rows of rollers are preferably angled outwardly from the bottom portion of load support 1. The inner rows of rollers are not angled outwardly, but instead are attached to a rail 6*a* which is attached perpendicularly to the bottom of load support 1. Such a configuration provides additional roller surface area for transporting the packaging material off of the load support 1. A first preferred embodiment of the packaging material transporting surface 1*b* includes two rows of angled non-driven rollers 2, as shown in FIG. 2A. A second preferred embodiment of the packaging material transporting surface 1*b* includes two outer rows of angled rollers 2 and two inner rows of non-angled rollers 10, as show in FIG. 2B. Other combinations of angled and non-angled rollers are possible, but not preferred.

Packaging material support guard 3, which covers the outside of rollers 2, is formed in a clam shell or cup shape. That is to say, the packaging material support guard 3 is shaped to cover the axles of the rollers 2, thus preventing the screws which are used to fasten the rollers 2 from coming in contact with the packaging material. The packaging material support guard 3 is also very thin, preferably made of a sixteen gage steel or sheet metal. The packaging material support guard 3 is more effective if it has not been painted. The packaging material support guard 3 may also be treated with a material such as zinc dichromate to minimize tacky film adhesion. The purpose of the packaging material support guard 3 is to (1) protect the packaging material from the screws fastening the rollers, (2) prevent the packaging material from becoming caught between the rollers by supporting the packaging material at each space between the rollers, and (3) provide a sliding surface to transport the packaging material between the wheel surfaces.

The key to the simplicity of the invention lies in the percentage of the wheel covered by the packaging material support guard and the amount of friction between the support guard and the packaging material. This relates to the percentage of the packaging material load carried on the moving roller surface, i.e., the non-driven roller surface, versus the non-moving surface, i.e., the packaging material support guard itself; the relative elevation of the non-moving surface with respect to the elevation of the moving roller surface, i.e., how far above the bottom surface of the moving rollers 2 the packaging material support guard 3 ends; and the packaging material guard being thin enough and properly shaped so as to get sufficiently close to the rolling surface without creating a large amount of contact between the packaging material and the non-moving surface to thereby avoid creating a high amount of friction. This non-driven moving roller surface, in combination with the packaging material support guard, may be used with or without a secondary conveyor surface.

Stretch wrapping apparatus 100 includes a cantilevered load support 1 having a top load support surface la and a non-powered bottom packaging material transporting surface 1*b*. The cantilevered load support 1 has a free end extending from an arm rotatable about a generally horizontal axis to wrap packing material around the top and bottom of the load in the wrapping area. As embodied herein and shown in FIGS. 3–5, a cantilevered packaging material dispenser 10 includes a dispenser support frame 18, a rotatable arm 20 formed in the shape of an L and having a vertical leg 22 rotatably journaled in dispenser support frame 18 and horizontal leg 23 having a free end 24 in the packaging material dispenser 12 supported on rotatable arm 20 near free end 24. Packaging material dispenser 12 includes the support for a roll of packaging material such as stretch wrap contained within a roll carriage and may also include a variety of rollers optionally including prestretch rollers for stretching the packaging material longitudinally and/or transversely to position, dispense and stretch the packaging material as packaging material 7 is being dispensed from the roll of packaging material. In this preferred embodiment stretch wrap packaging material is used. However, various other packaging material such as netting, strapping, banding or tape can be used as well.

Figure 3:
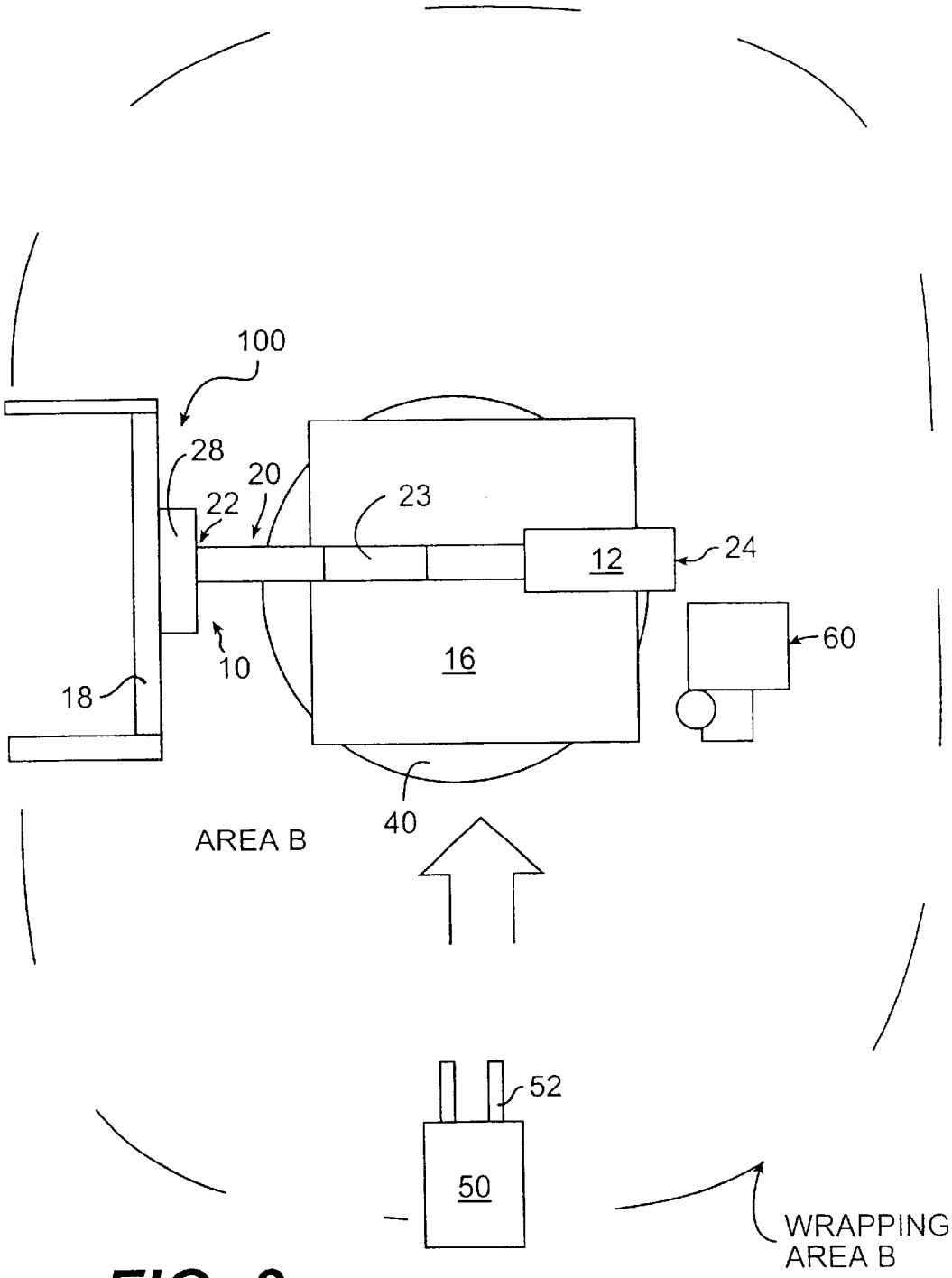
FIG. 3 is a top view of the apparatus of FIG. 1.
Figure 4:
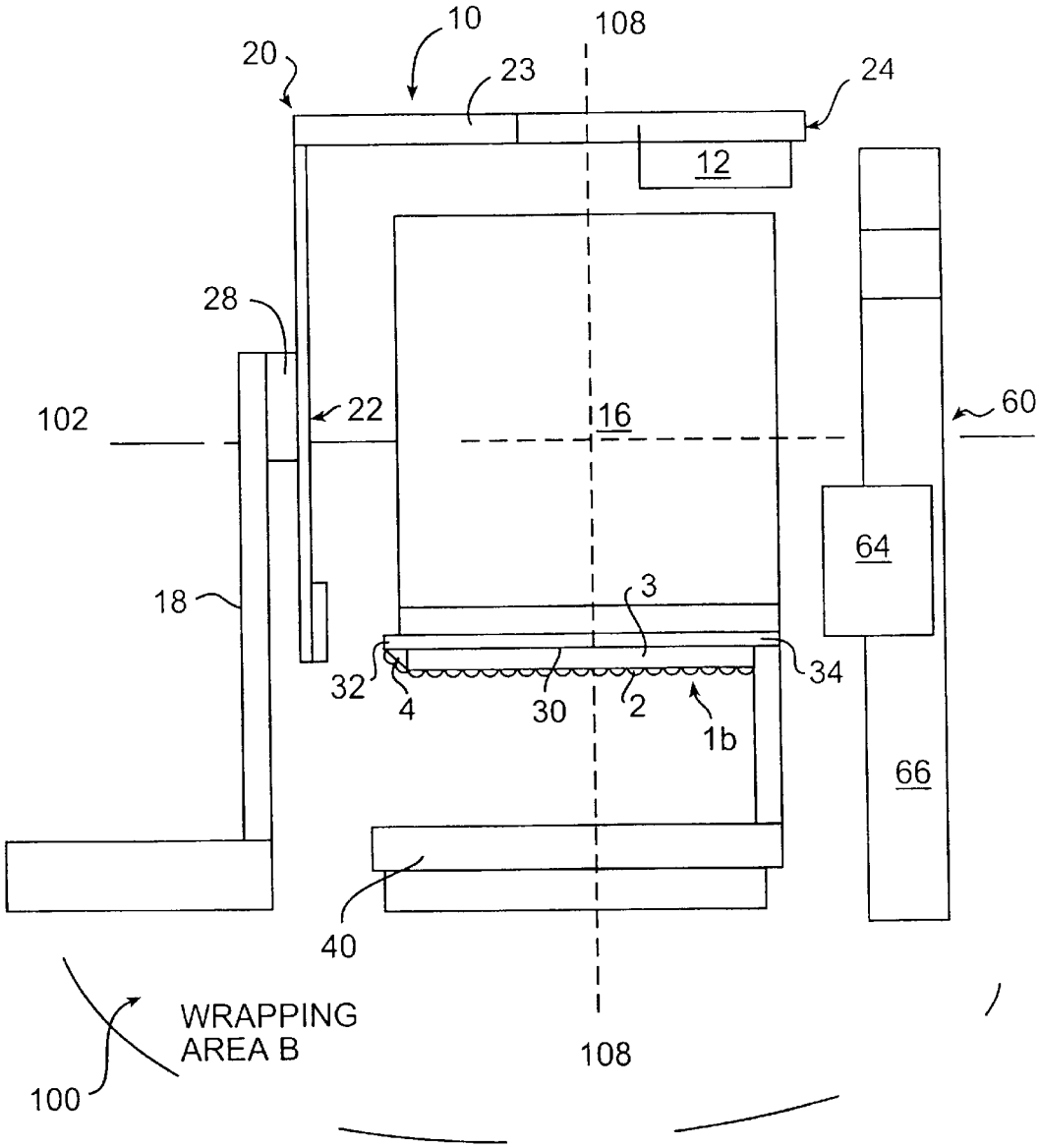
FIG. 4 is a more detailed side view of the apparatus of FIG. 1.
Figure 5:
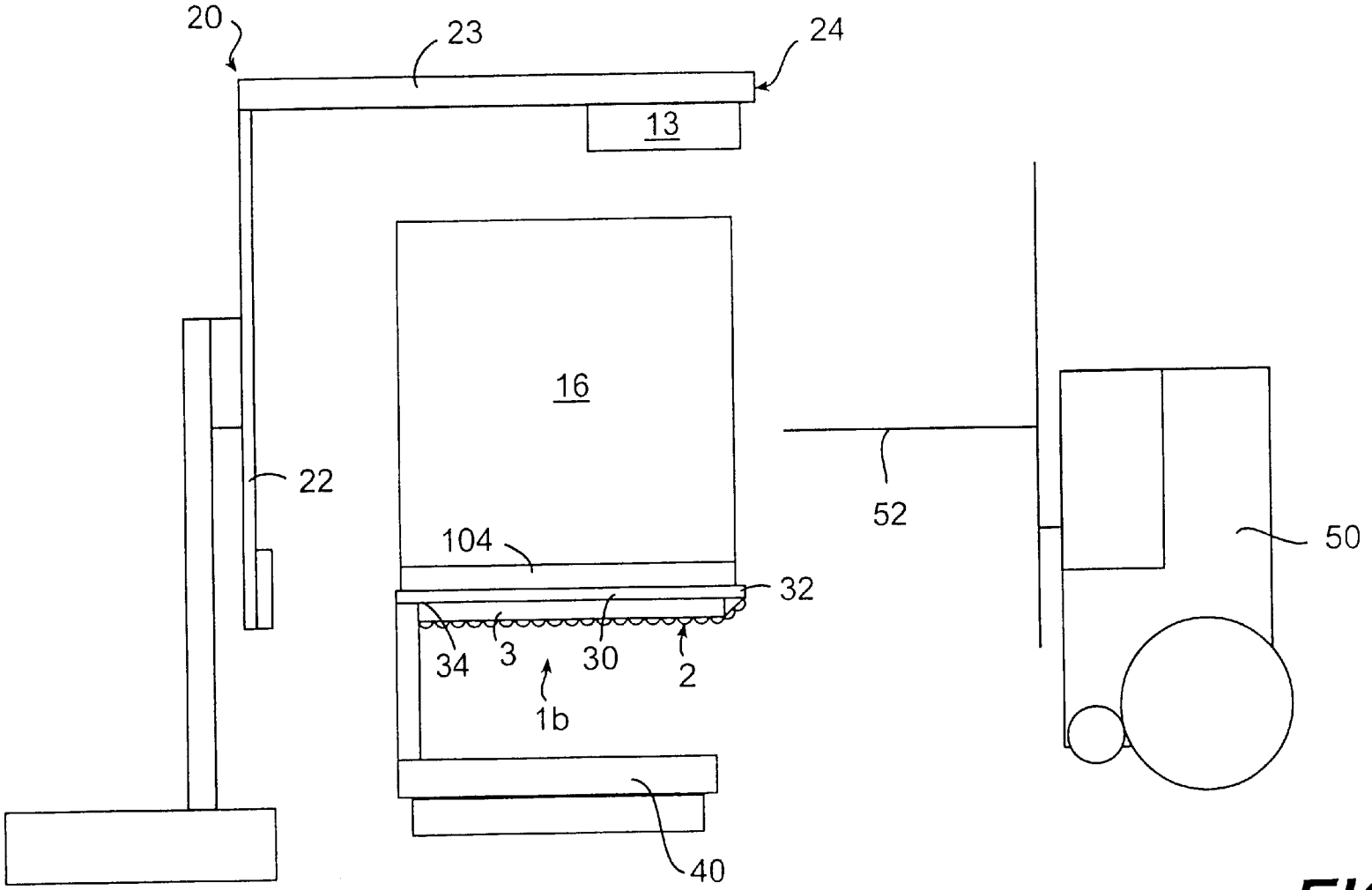
FIG. 5 is a side view of the apparatus of FIG. 4 in use.
Figure 6:
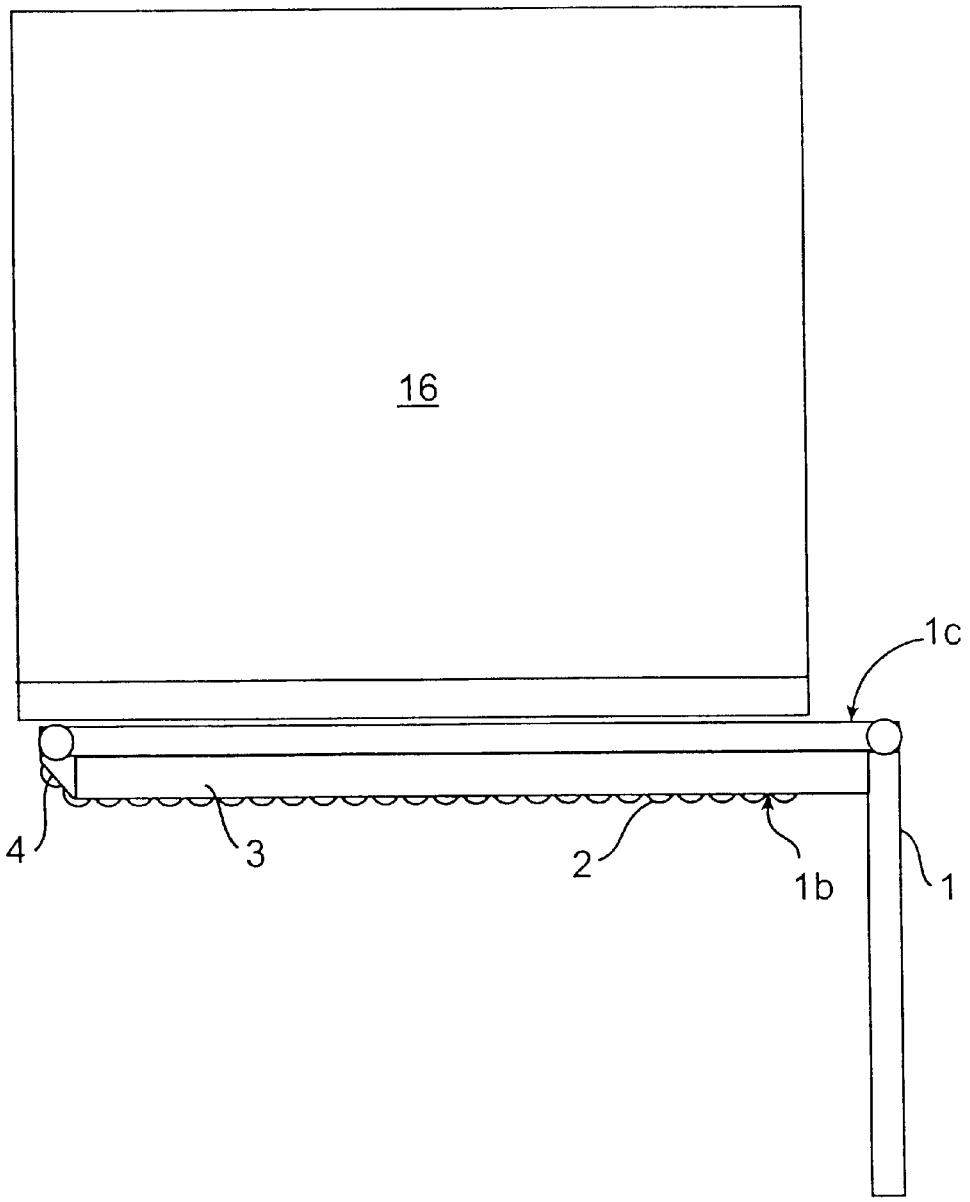
FIG. 6 is a side view of an apparatus for wrapping a load according to a second embodiment of the present invention.
Figure 7:
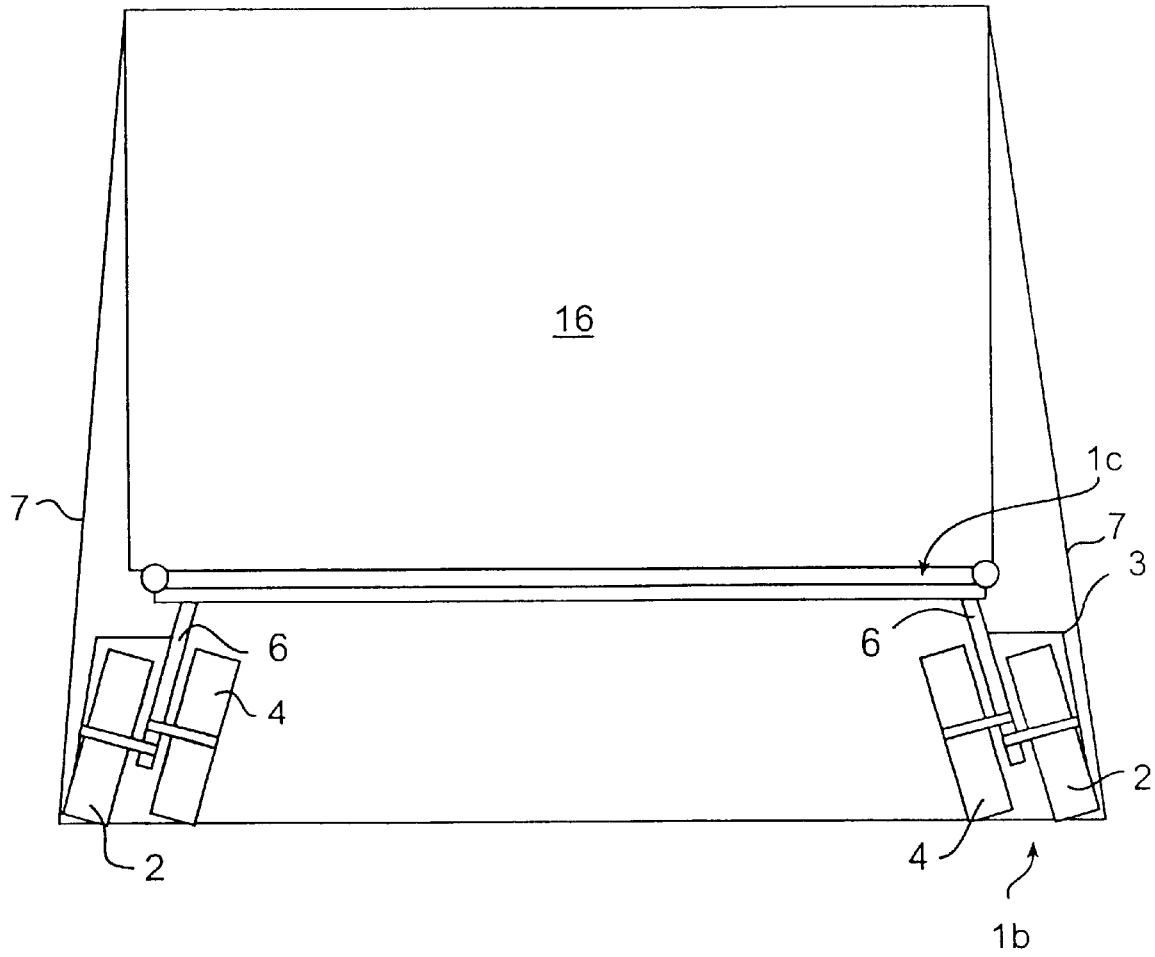
FIG. 7 is a front view of the apparatus of FIG. 6.
Figure 8:
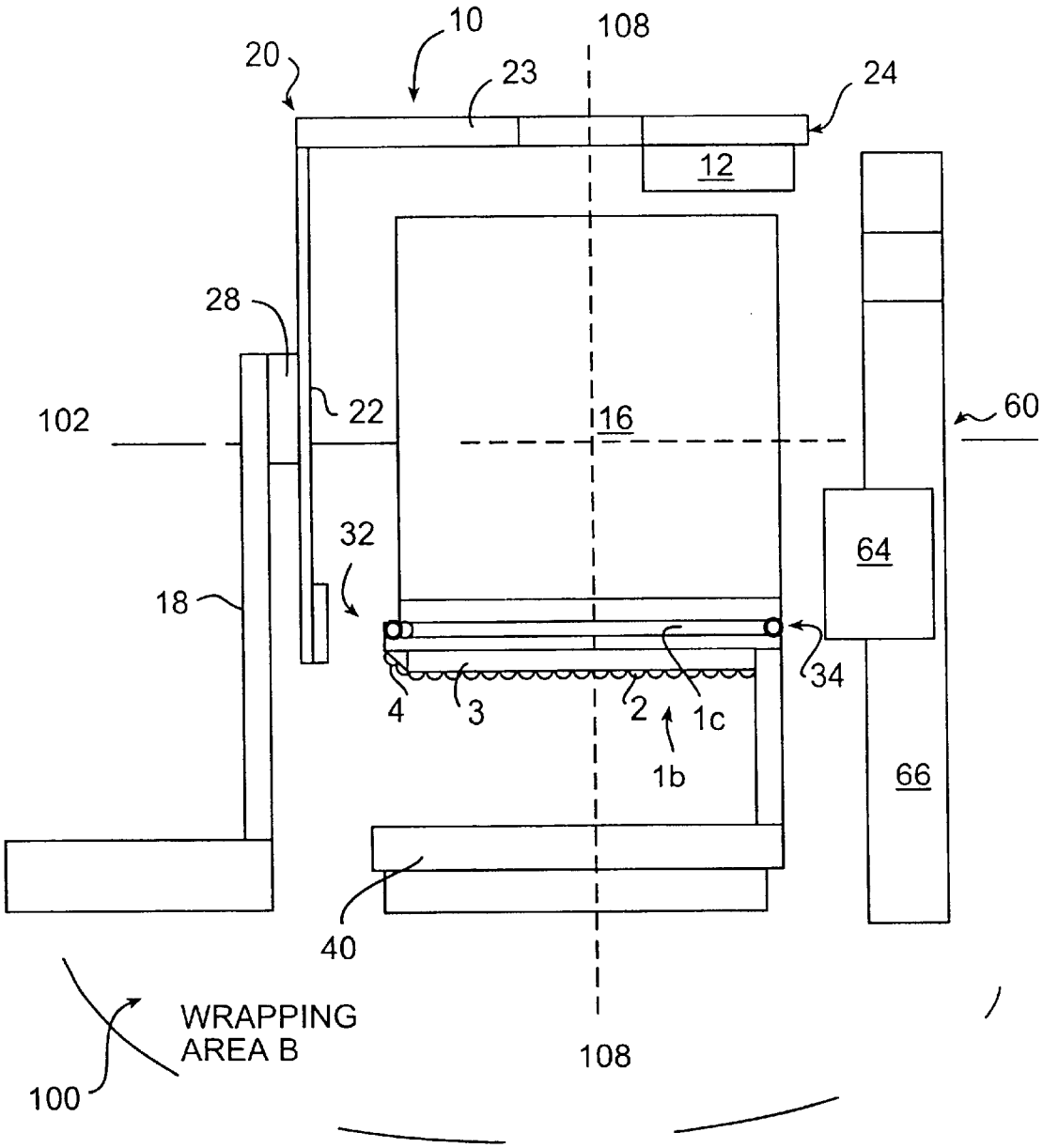
FIG. 8 is a more detailed side view of the apparatus of FIG. 6.
Figure 9:
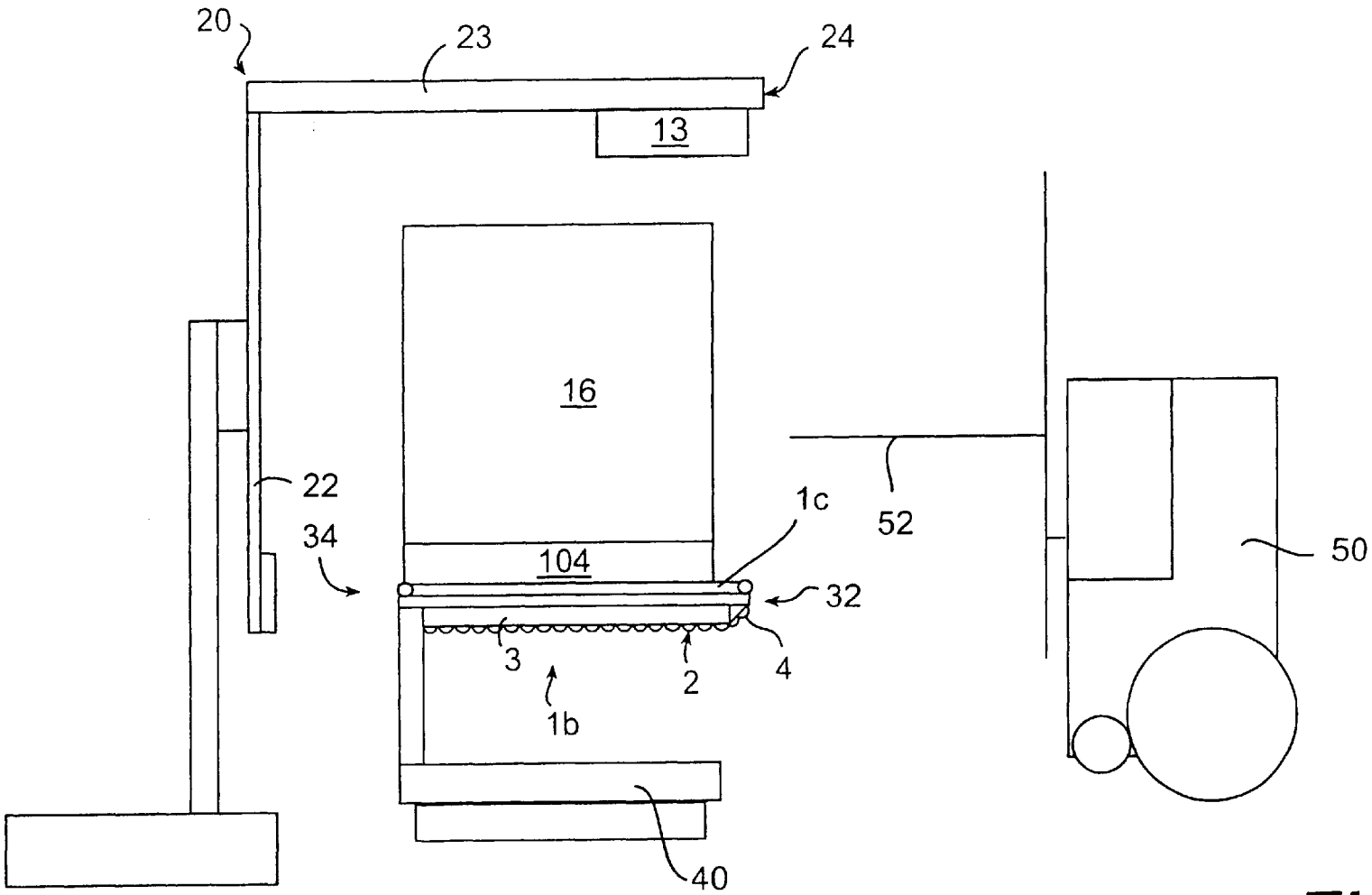
FIG. 9 is a side view of the apparatus of FIG. 8 in use.

Packaging material dispenser 12 may be horizontally movable and motor driven on a horizontal leg 23 of the L of rotatable arm 20 to dispense packaging material 7 spirally about load 16 as arm 20 rotates about load 16. As shown in FIGS. 3–5, dispenser 12 may be small in size relative to the size of retainable arm 20 and movable horizontally along rotatable arm 20 to dispense packaging material 7. Alternatively, dispenser 12 may have a length similar to the size of leg 23 of rotatable arm 20, such that there is no need for a dispenser 12 to move along rotatable arm 20 while dispensing packaging material 7. A sheet of packaging material 7 would be of such a size that it would cover a side of a load 16 during a single rotation of arm 20 about load 16.

As shown in FIGS. 3–5, a motor drive 28 is provided for providing relative rotation around a generally horizontal axis 102 between the packaging material dispenser 12 in the load 16 to wrap packaging material 7 about the top and bottom of load 16. Drive 28 rotates rotatable arm 20 in dispenser 12 about generally horizontal axis 102 to wrap packaging material around the top and bottom of load 16.

According to the present invention, a cantilevered load support with a free end, having a top load support surface and a bottom non-powered packaging material transporting surface, is mounted and movable between a wrapping position, where the cantilevered load support surface and the cantilevered packaging material dispenser are generally aligned and intermeshed, and a load transfer position, where the wrap load may be removed from the free end of the load support in a generally horizontal direction without interfering with the cantilevered packaging material dispenser.

As embodied and shown in FIGS. 1–5, cantilevered load support 1 includes a free end 32, a supported portion 34, a top load supporting surface 1*a*, and a bottom non-powered packaging material transporting surface 1*b*. Free end 32 of cantilevered load support 1 is positionable to be generally aligned and intermeshed with the free end 24 of cantilevered packaging material dispenser 10. In this position, defined as a wrapping position, free end 24 of cantilevered packaging material dispenser 10 is aligned so it extends generally parallel to, rather than perpendicular to the cantilevered load support 1.

Free end 32 of cantilevered load support 1 is intermeshed so it extends within the cylinder of movement described by the rotatable horizontal leg 23 and the free end 24 of cantilevered packaging material dispenser 10 with the free end 32 of the cantilevered load support generally facing toward dispenser support frame 18. In the wrapping position, wrapping occurs as the free ends 24, 32 are aligned and intermeshed as rotatable arm 20 can rotate about generally horizontal axis 102 to revolve around free end 32 and adjacent to supported portion 34 of cantilevered load support 1 to wrap packaging material 7 around free end 32 and load 16.

Because the packaging material 7 is wrapped around load 16 and free end 32, load 16 is banded to cantilevered load support 1 such that supported portion 34 of cantilevered load support 1 prevents passage of the packaging material and removal of the load from the supported portion 34. Additionally, because load 16 is bound to cantilevered load support surface 1 by packaging material 7, load 16 cannot be removed vertically from load support 1. Wrapped load 16 is removed from cantilevered load support 1 off of free end 32 in a horizontal direction. Namely, generally parallel with free end 32.

Free end 32 of cantilevered load support 1 may also be positionable such that free end 32 does not face dispenser support frame 18 of cantilevered packaging material dispenser 10. For example, the free end 32 of the cantilevered load support may face in the same direction as the free end 24 of the cantilevered packaging material dispenser 10 such that the cantilevered load support 1 is generally aligned with the horizontal portion of rotatable arm 20 as shown in FIG. 5. Alternatively, free end 32 may not face dispenser support frame 18 of cantilevered packaging material dispenser 10 and the free end 32 of the cantilevered load support may not face in the same direction as the free end 24 of the cantilevered packaging material dispenser 10 such that the cantilevered load support 1 is not aligned with the horizontal leg 23 of rotatable arm 20 but is somewhat perpendicular to the horizontal leg 23 of rotatable arm 20. In these positions, defined as the load transfer positions, it is possible for load 16 to be transferred in a horizontal direction between the free end 32 of load support 1 and a load transporter without interfering with cantilevered packaging material dispenser 10 and particularly not interfering with dispenser support frame 18 of the cantilevered packaging material dispenser 10.

Free end 32 of cantilevered load support 1 is mounted and movable in the wrapping area B between the wrapping position and the load transfer position. "Mounted and movable within the wrapping area" defines the cantilevered load support being located in the wrapping area throughout the in-feed wrapping and out-feed operations. The wrapping area is defined as the area within the general vicinity of the wrapping as opposed to areas remote from wrapping occurs and has been depicted, for example, in the figures as wrapping area B.

As shown in FIGS. 3–5, cantilevered load support 1 may be mounted on a turntable 40 which is in turn mounted in the wrapping area B. Turntable 40 is rotatable to move free end 32 of cantilevered load support 1 between the wrapping position and the load transfer position. As shown in FIGS. 3–5, free end 32 of cantilevered load support 1 is in a wrapping position and faces dispenser support frame 18 for wrapping load 16 and as shown in FIG. 5, free end 32 of cantilevered load support 1 is in a load transfer position and faces away from dispenser support frame 18 so that load 16 can be removed in a generally horizontal direction from the free end 32.

According to the present invention, a load transporter for transporting and transferring the load from the cantilevered load support and the wrapping area is provided. As embodied herein, the term "forklift truck" is intended to include all such vehicles that pick up, support and transport the load, such as a clamp truck, and including other vehicles generally referred to by other names. Any such vehicle may include support tines, clamps, squeezer clamps, or any other pull pack attachments or adder components for gripping or picking up a load.

As embodied and shown in FIG. 5, the load transporter may include a forklift truck 50 having support tines 52. After the load is wrapped, turntable 40 rotates to move free end 32 of cantilevered load support 1 to the load transfer position. Forklift truck 50 moves into wrapping area B, and using support tines 52 removes wrapped load 16 in a generally horizontal direction from the free end 32 of cantilevered load support 1, and transports the wrapped load out of the wrapping area B to a storage or shipping area. As shown, it is possible to align the support tines 52 of forklift truck 50 with a pallet 104 supporting load 16 to facilitate removing load 16 from free end 32 of cantilevered load support 1. Because packaging material 7 is wrapped about load 16 and the cantilevered load support 1, and bottom packaging material transporting surface holes in pallet 104 supporting load 16 are accessible to support tines 52. In this configuration, forklift truck 50 inserts tines 52 into holes in pallet 104 and pulls load 16 off free end 32 of cantilevered load support 1, also pulling packaging material 7 along the rollers 2 of the bottom packaging material transporting surface 1*b* such that packaging material 7 wrapped about cantilever load support 1 slides off end rollers 4 of bottom packaging material transporting surface 1*b* and off of free end 32 to snap into place underneath load 16 as it is removed from free end 32.

If load 16 is not on a pallet, other options may be more desirable to remove load 16 from cantilevered load support 1. For example, a pushing mechanism may be used to push load 16 off of free end 32 of cantilevered load support 1 and onto the load transporter. Alternatively, cantilevered load support 1 may be moveable between a load infeed conveyor and a load outfeed conveyor, such that free end 32 receives the load, moves into the wrapping position, and moves to the load transfer position to allow load 16 to be transferred to a conveyor mechanism which will convey both load 16 and packaging material 7, above and below the conveyor, respectively.

Additionally, it is possible to use forklift truck 50 to transport load 16 into wrapping area B and transfer load 16 onto cantilevered load support 1. It is preferable but not necessary that a load be transferred onto cantilevered load support 1 in a horizontal direction from the free end 32 of cantilevered load support 1. It may be transferred onto load support 1 from the supported portion 34, or from one of the sides. In a less preferred embodiment, load 16 may be transferred onto cantilevered load support 1 from a vertical direction.

According to one aspect of the present invention, apparatus 100 may include means for providing relative rotation about a generally vertical axis between a dispenser and the load to wrap packaging material around the sides of the load. As embodied and shown in FIGS. 3–5, turntable 40 is rotatable about a generally vertical axis 108 to provide relative rotation between load 16 and a packaging material dispenser.

As shown in FIGS. 3–5, a second packaging material dispenser 60 may be provided. Packaging material dispenser 60 dispenses a sheet of packaging material 62 in a web form. Packaging material dispenser 60 includes a roll of packaging material contained within a roll carriage 64 and may also include a variety of rollers, optionally including prestretch rollers for stretching the packaging material longitudinally and/or transversely, to position, dispense, and stretch the packaging material 62 as packaging material 62 is being dispensed from the roll of packaging material. Roll carriage 64 of dispenser 60 is vertically moveable on mast 66 to dispense packaging material 62 spirally about load 16 as turntable 40 rotates load 16. Alternatively, a second packaging material dispenser mounted on a rotatable arm may be used. In a preferred embodiment, stretch wrap packaging material is used, however various other packaging materials such as netting, strapping, banding, or tape can be used as well.

Alternatively, the same packaging material dispenser may be used to wrap packaging material around the top and bottom of the load as well as the sides of the load. For example, rotatable arm 20 might include an extendable portion for extending vertically downward from rotatable arm 20 and upon which dispenser 12 might move vertically along such an extensible portion to dispense packaging material 7 spirally about load 16 as turntable 40 rotates load 16.

According to the present invention, apparatus 100 preferably includes a controller, such as a microprocessor, or an electromechanical or other controller. The controller is preferably an integrated controller that controls several of the various operations in the wrapping process such as the movement of the cantilevered load support surface between the wrapping position and the load transfer position, the rotation of the rotatable arm and dispenser, the rotation of the turntable, or a combination of any or all of the above. This is in contrast to using one controller to operate the wrapper and another, separate controller such as a forklift truck, to control the positions of the load during holding and positioning of the load during wrapping In an alternative embodiment as shown in FIGS. 6–9, instead of pushing, pulling, or using load transport means to pull the load off of the cantilevered load support 1, a powered top load support surface 1*a* may be provided. Powered top load support surface 1*a* may take the form of a conveyor surface 1*c*, a powered roller surface, or a powered surface having moving belts or the like. Thus, once the load 16 is wrapped, the conveyor 1*c* can be actuated to move the load 16 off of the load support 1. As the load 16 moves, the packaging material 7 wrapped about the load 16 and the load support 1 is moved along the non-driven rollers 2 and packaging material support guard 3 of packaging material transporting surface 1*b* as previously discussed. Alternatively, top load support surface 1*a* may include non-driven rollers.

Figure 10:
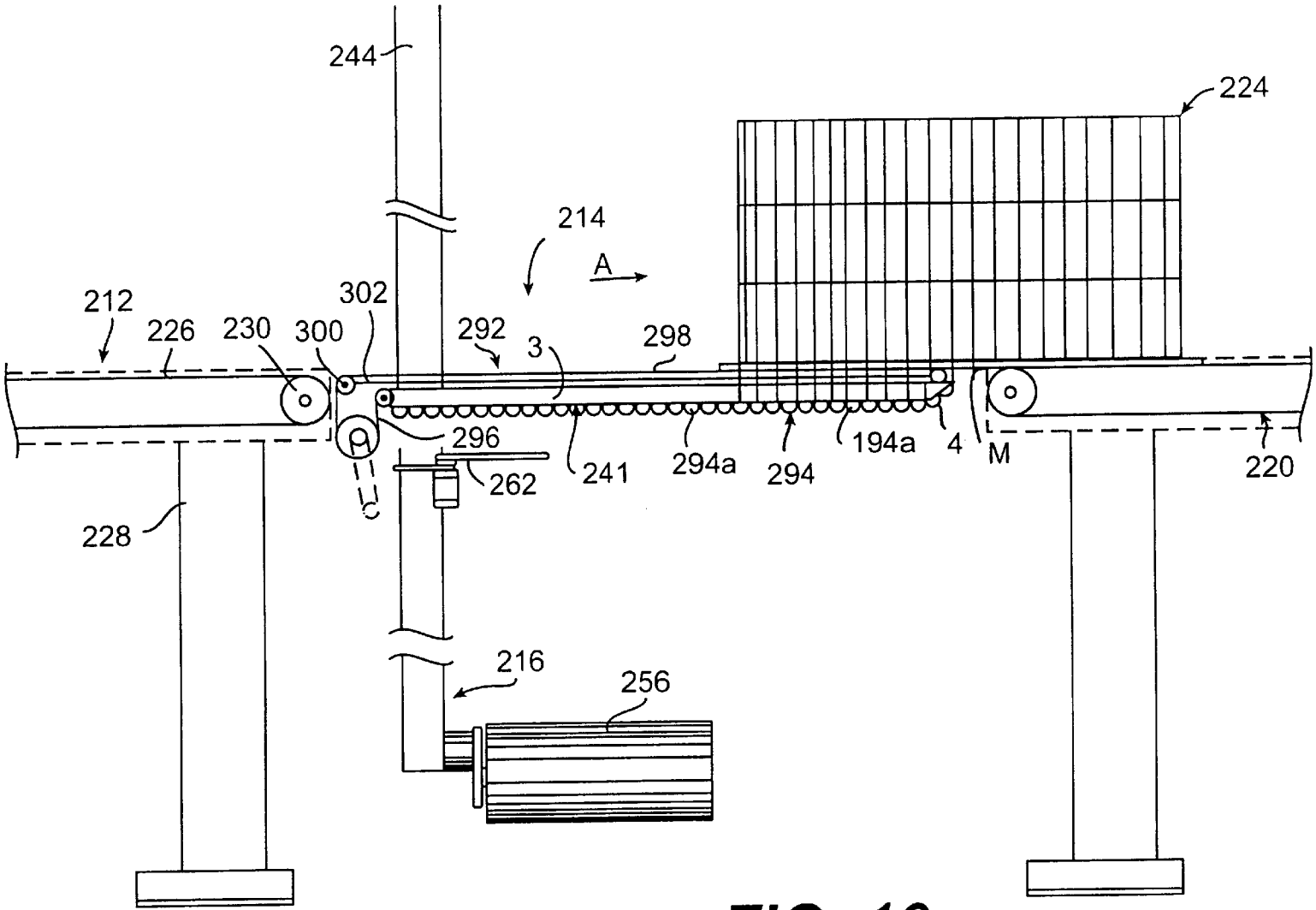
FIG. 10 is a side view of an apparatus for wrapping a load according to a third embodiment of the present invention.
Figure 11:
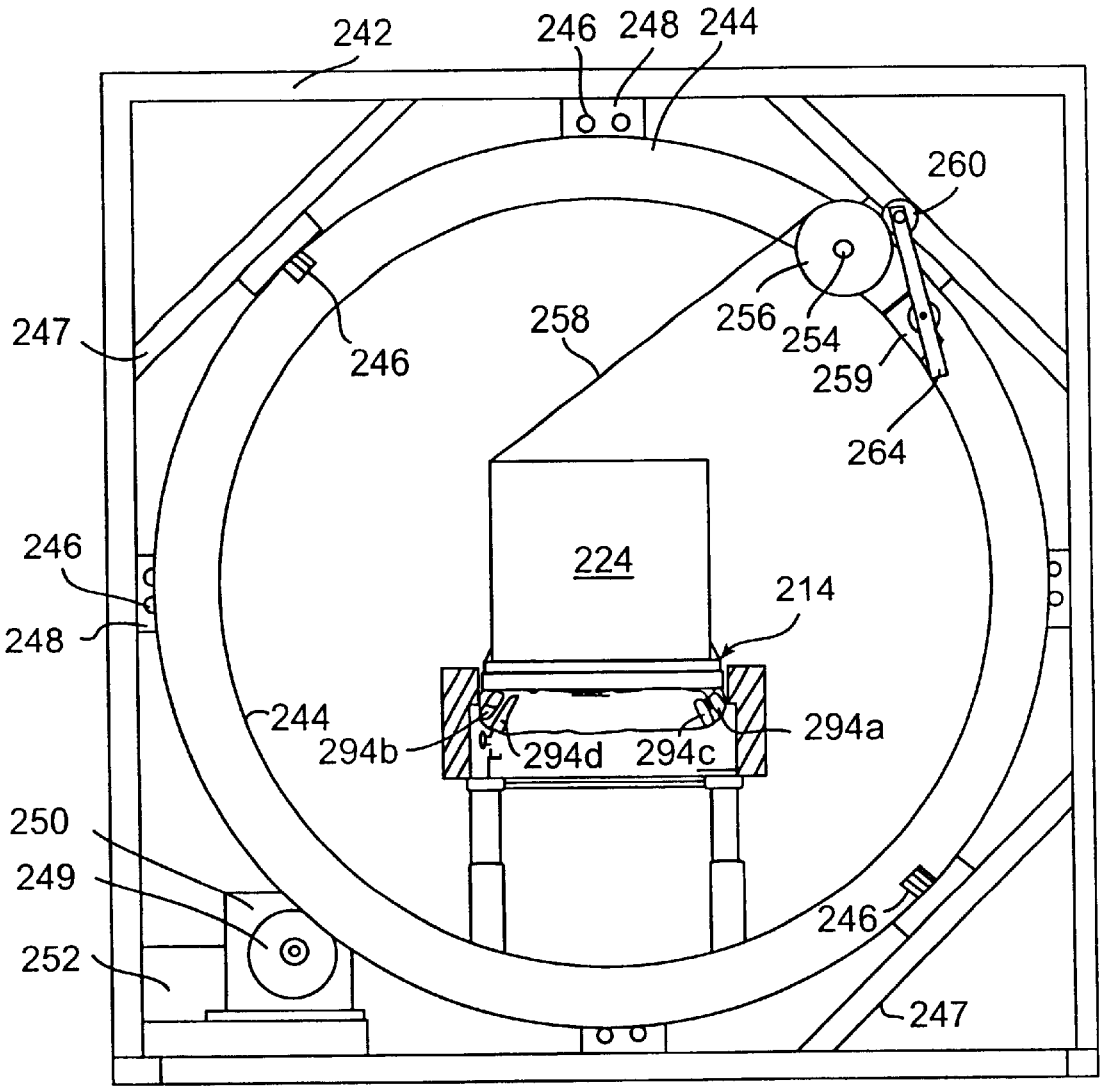
FIG. 11 is a front view of the apparatus of FIG. 10.

In a second preferred embodiment of the invention, shown in FIGS. 10 and 11, instead of providing a cantilevered load support 1, a wrapping conveyor 214 having a top load support surface and a non-powered bottom packaging material transfer surface is provided.

The invention, as embodied herein and shown in FIGS. 10 and 11, includes a ring wrapping apparatus 210 comprising a feed conveyor 212, a wrap and load conveyor assembly 214, a packaging material dispensing mechanism 216 with a cutting mechanism (not shown) and a take off conveyor 220.

The load 224 is placed on an infeed conveyor 212 which includes an endless belt 226 mounted on a frame support 228.

The endless belt 226 is mounted on rollers 230 which are rotatably journaled by suitable bearing means and brackets which are secured to the frame support 228. The infeed conveyor 212 carries the load 224 onto a wrapping station 241 including a packaging material dispensing apparatus 216 and a wrapping conveyor assembly 214.

The wrapping assembly includes a frame 242 on which a steel donut or ring shaped packaging material support member 244 is rotatably mounted and supported on three planes by guide rollers 246. If desired, the packaging material support member 244 can be constructed of aluminum. A plurality of guide rollers 246 project inward from the frame 242 on arms 247 and mounting plates 248 to engage the ring shaped member 244 so that it can be driven in a predetermined path. A friction drive wheel 249 is positioned adjacent the ring member 244 at its base and engages the member 244 to rotate the member 244 within the guide wheel rolling area. The friction drive wheel 249 is driven by a motor 250 having a shaft which is suitably connected with a drive reducer 252. Material roll dispensing shaft 254 is rotatably secured to the ring member 244 for rotation on its axis and is adapted to receive and hold a roll of packaging material 256.

The wrapping conveyor assembly 214 comprises two conveying surfaces 292 and 294. The top load supporting and conveying surface 292 is a standard plate type conveyor well known in the art comprising a driven endless belt 296 mounted on a plurality of rollers 300. The rollers 300 are supported by plates 302 secured in turn to a frame member (not shown) which holds the rollers in a rotatable position. The endless belt 296 is rotated in a direction which moves anything on the belt 296 through the wrapping device 241 in a direction forming from the infeed conveyor 212 toward the take-off conveyor 220. Belt 296 is driven by a motor assembly 304 which is connected by gears 306 and linkages 308 in the form of chains or belts to drive the conveyor.

Lower packaging material transporting conveyor 294 is a non-driven conveyor and includes two sets of inline rollers 294*a* and 294*b* mounted to an outer surface of a rail 206 (not shown) on either side of a conveying surface of conveyor 292. These rollers are inline directly one behind the other to form two rows of rollers. Non-driven rollers 2 are preferably roller skate wheels, approximately two inches in diameter, aligned in an inline configuration. Other sizes or types of wheels may be used, however, currently preferred are roller skate wheels which are inexpensive, easy to find, of the appropriate size, and commonly used in carton conveyors. Alternatively, more than two rows of rollers may be used, or only a single row of rollers may be used.

The rollers 294*a*, 294*b* are preferably canted or angled outwards from the vertical such that they form an angle with the vertical of between 10 and 45 degrees. Located on an outer side surface of these rollers and connected to upper conveyor 292 is a packaging material support guard 295. Packaging material support guard 295 is positioned on the outside exposed roller surfaces (the sides of the rollers 294*a*, 294*b* not adjacent to the rails) of non-driven rollers 294*a*, 294*b* so as to be located between the outside roller surfaces and the packaging material during wrapping.

The packaging material support guard 295 covers between 75% and 95% of the outer roller surfaces which face the packaging material when packaging material has been wrapped around the load 224 and wrapping conveyor assembly 214. More preferably, packaging material support guard 295 covers between 88% and 94% of the outer roller surfaces. The portion of the roller surfaces not covered by the guard 295 are the lowermost portions of the roller surfaces on which the package material will move. For example, in a roller having approximately a 2" diameter, the following ranges of covered roller surfaces versus non-covered roller surfaces might be used. For each ratio, the measurement of the amount of surface covered is taken from the top of the wheel adjacent the load bearing surface 1*a* towards the bottom of the wheel surface which will carry the packaging material. If the amount of surface covered is too small, the packaging material will still become caught between the rollers, preventing movement of the packaging material and rotation of the rollers. Additionally, if the amount of surface covered is too large, there will be a large amount of friction between the packaging material support guard 295 and the packaging material, resulting in tearing of the film and prevention of movement of the film. Preferred ranges include, for an approximately 2" diameter wheel, land ½" (75%) of the wheels covered by the packaging material support guard 295, and the lowermost ½" of the wheels uncovered; 1 and ¾" (approximately 88%) of the wheels covered by the packaging material support guard 295, and the lowermost ¼" of the wheels uncovered; and in a most preferred range, 1 and ⅞" (approximately 94%) of the wheels covered and the lowermost ⅛" of the wheels uncovered. These values, given for an approximately 2" diameter wheel, can be converted to their respective percentages and applied to any given wheel size. Generally, it is preferred that between 75% and 95% of the outer surfaces of the wheels be covered, and between 25% and 5% of the lowermost portions of the wheels be uncovered. More preferably, between 88% and 94% of the outer surfaces of the wheels are covered, and between 12% and 6% of the lowermost portions of the wheels are uncovered.

At the end of the lower packaging material transporting conveyor, positioned near the take off conveyor, are last rollers 294*c*, 294*d* which are laterally and/or vertically raised from the plane of the other non-driven rollers 294*a*, 294*b*, and are offset inwardly from non-driven rollers 294*a*, 294*b*, being attached to an inner side of rail 6. These last rollers 294*c*, 294*d* ensure a smooth packaging material feed at the end of the conveyance, as the packaging material slides off of the rollers to snap in place around the load 224. Rollers 294*c*, 294*d* are preferably angled outwardly from the vertical between 10 and 45 degrees.

As stated earlier, non-driven rollers 294*a*, 294*b* are angled outwardly from the vertical. Preferably, the non-driven rollers 294*a*, 294*b* are angled from the vertical 10 to 45 degrees. Alternatively, if more than two rows of rollers are provided, the outermost rows of rollers are preferably angled outwardly from the vertical. The inner rows of rollers are not angled outwardly, but instead are attached to a rail which is arranged below and perpendicular to the top load supporting and conveying surface 292. Such a configuration provides additional roller surface area for transporting the packaging material off of the wrapping conveyor assembly 214. A first preferred embodiment of the lower packaging material transporting conveyor includes two rows of angledn on-driven rollers 294*a*, 294*b*. A second preferred embodiment of the lower packaging material transporting conveyor includes two outer rows of angled rollers 294*a*, 294*b* and two inner rows of non-angled rollers. Other combinations of angled and non-angled rollers are possible, but not preferred.

Packaging material support guard 295, which covers the outside of rollers 294*a*, 294*b*, is formed in a clam shell or cup shape. That is to say, the packaging material support guard 295 is shaped to cover the axles of the rollers 294*a*, 294*b*, thus preventing the screws which are used to fasten the rollers 294*a*, 294*b* from coming in contact with the packaging material. The packaging material support guard 295 is also very thin, preferably made of a sixteen gage steel or sheet metal. The packaging material support guard 295 is more effective if it has not been painted. The packaging material support guard 295 may also be treated with a material such as zinc dichromate to minimize tacky film adhesion.

As described above with respect to the first embodiment of the present invention, the key to the simplicity of the invention lies in the percentage of the wheel covered by the packaging material support guide and the amount of friction between the support guide and the packaging material. This relates to the percentage of the packaging material load carried on the moving roller surface, i.e., the non-driven roller surface, versus the non-moving surface, i.e., the packaging material support guard itself; the relative elevation of the non-moving surface with respect to the elevation of the moving roller surface, i.e., how far above the bottom surface of the moving rollers 294*a*, 294*b* the packaging material support guard 295 ends; and the packaging material guide being thin enough and properly shaped so as to get sufficiently close to the rolling surface without creating a large amount of contact between the packaging material and the non-moving surface to thereby avoid creating a high amount of friction.

This construction of the wrapping conveyor assembly 214 allows packaging material 258 to be wrapped around a load 224 which was carried from the infeed conveyor 212 onto the wrapping station 241. The packaging material 258 is wrapped around the wrapping conveyor assembly 214 and the load 224 with both the load 224 and packaging material 258 being carried by the conveyor assembly 214 in the same direction. In all wrapping modes—full web, spiral and banding modes—the conveyor assembly 214 and wrapping ring 244 are stopped and a clamp apparatus 262 clamps the packaging material web and the cutter mechanism severs the packaging material web. The conveyor assembly 214 is activated carrying the load and wrap downstream to a takeoff conveyor 220. When the load 224 encounters the takeoff conveyor 220, the elongated stretched wrap 258 coming off the end of the conveyor assembly over last inset rollers 294*c*, 294*d* assumes its memory position M against the load in the space between the conveyor assembly 214 and takeoff conveyor 220, allowing the contained load covered by stretch wrap to be carried away.

The wrapping conveyor assembly 214 leads from the infeed conveyor 212 to a takeoff conveyor 220 which is constructed like the infeed conveyor 212 and runs at the same speed as the infeed conveyor 212. In order to control both conveyors at the same rate of speed, a suitable mechanical means not shown is set up to make the drive of both the infeed conveyor 212 and the takeoff conveyor 220 equal to reduction gearing assembly of the drive motor. Thus, if the motor slows down or speeds up to drive the wrapping mechanism at different speeds, the infeed and takeoff conveyors simultaneously speed up or slow down so that the load moves to conveyor assembly 214 and is taken away from the conveyor assembly 214 at consistent relative speeds.

A method for wrapping a load according to the first embodiment of the present invention will now be described. As shown and according to a preferred embodiment of the present invention, a load 16 is transported by a forklift 50 into a wrapping area B and is then transferred to cantilevered load support 1 having a top load support surface 1*a* and a bottom packaging material transporting surface 1*b* including non-driven rollers 2 and packaging material support guard 3. Cantilevered load support 1 is mounted and moveable within the wrapping area, the wrapping area B having a cantilevered packaging material dispenser 10 including a dispenser 12, a rotatable arm 20 having a free end 24 and supporting dispenser 12, and a dispenser support frame 18.

Once load 16 is positioned on top load bearing surface 1*a* of cantilevered load support 1, a free end 32 of cantilevered load support 1 is moved into a wrapping position, where free end 32 of cantilevered load support 1 is positioned such that it faces generally toward dispenser support frame 18 and is generally aligned with the horizontal portion of rotatable arm 20, while the free end 24 of rotatable arm 20 faces generally away from dispenser support frame 18. Free end 32 of cantilevered load support 1 is moved into the wrapping position by rotation of turntable 40 on which it is mounted.

A leading end portion of a sheet of packaging material 7 is attached to the load, or the load support 1, and motor driven "L-shaped" rotatable arm 20 begins to rotate dispenser 12 in a circle about a horizontal axis 102 and about load 16 sitting on cantilevered load support 1. As rotatable arm 20 rotates, dispenser 12 moves horizontally along rotatable arm 20 and dispenses packaging material 7 around the top, and as arm 20 passes below free end 32 of cantilevered load support 1, the bottom non-powered packaging material transporting surface 1*b*.

Once packaging material 7 has been dispensed, the packaging material 7 is severed, and optionally may be smoothed onto load 16 in a conventional way. At this time, it is possible to wrap the sides of the load if so desired. Relative rotation is provided about a generally vertical axis 108 between load 16 and a second packaging material dispenser 60 mounted and vertically moveable on mast 66. In the preferred embodiment, turntable 40 rotates about vertical axis 108 to rotate load 16 and wrap packaging material 62 about the sides of load 16. In an alternative, less preferred embodiment, dispenser 12 is manipulated to extend downwardly from rotatable arm 20, and turntable 40 rotates to provide relative rotation between dispenser 12 and load 16 to wrap packaging material around the sides of the load. Alternatively, it is possible to perform wrapping the sides of the load after the free end 32 has been moved to the load transfer position.

After the sides of load 16 have been wrapped, turntable 40 rotates to move the free end 32 of cantilevered load support 1 to a load transfer position, where free end 32 of cantilevered load support 1 is positioned such that it generally does not face toward dispenser support 18. It may face in the same direction as free end 24 of cantilevered packaging material dispenser 12 and be aligned with the horizontal portion of rotatable arm 20, or alternatively, free end 32 may not face in the same direction as free end 24 of cantilevered packaging material dispenser 12 and the cantilevered load support 1 may be somewhat askew of or perpendicular to the horizontal portion of rotatable arm 20. In either instance, the free end 32 is positioned such that access to it is no longer blocked by dispenser support frame 18 of the cantilevered packaging dispenser. If the sides of the load have not been previously wrapped, it is possible to do so at this point.

Once free end 32 is positioned in the load transfer position, the wrapped load 16 is removed in a generally horizontal direction from free end 32 of cantilevered load support 1. As shown in FIG. 5, forklift truck 50 faces and aligns support tines 52 with free end 32 of cantilevered load support 1 to remove the load from the free end 32 of cantilevered load support 1. Tines 52 are placed into holes of pallet 104 to pick up and remove load 16 from the free end 32. As load 16 is removed, packaging material 7, wrapped around bottom packaging material transporting surface 1*b* of cantilevered load support 1, moves along non-driven rollers 2 and ultimately, slides off of free end 32 and snaps into place about load 16. Non-driven rollers 2 rotate as the packaging material 7 is pulled toward the free end 32. Packaging material support guard 3 ensures that packaging material 7 is not wrapped so tightly about non-driven rollers 2 that the rollers 2 cannot move due to the force exerted on them by the packaging material. In addition, packaging material support guard 3 ensures that the packaging material 7 does not become caught between the non-driven rollers 2 as the packaging material is pulled toward the free end 32 of cantilevered load support 1. Once the load is removed, forklift truck 50 transports wrapped load 16 away from the cantilevered load support 1 and the wrapping area B.

If the load support 1 includes the conveyor surface 1*c* as shown in FIGS. 6–9, the process as described above remains essentially the same. However, instead of placing the load onto the top load support surface, the conveyor surface may move the load up onto the top load support surface. Additionally, after wrapping, when the free end of the load support 1 is in the load transfer position, the conveyor surface 1*c* is actuated to move the load toward the free end of the load support and off of the load support. The non-driven rollers 2 and packaging material support guard 3 act as described above to facilitate passing the packaging material wrapped below the load support, about the bottom packaging material transfer surface, off of the packaging material transfer surface as the load is removed from the top load support surface.

As can be seen, with these embodiments, a simple inexpensive turntable that merely moves only rotationally about a vertical axis may be used to position the load, and it also may be used to wrap the load sides. All of the functions can be controlled with a typical programmed microprocessor or other controller devices such as those conventionally used with stretch wrapping apparatus. The non-driven rollers rotate as the packaging material is pulled over them, facilitating removal of the load from the load support. The packaging material support guard reduces roping and sticking of the packaging material as the load is removed from the load support.

A method for wrapping a load according to the second embodiment of the present invention will now be described. In the operation of the inventive wrapping apparatus, full web, spiral web, and banding modes of operation are substantially identical manner. In these modes, a feed conveyor 212 brings the load 224 onto the top load supporting and conveying surface 292 of wrapping conveyor assembly 214. Load supporting and conveying surface 292 then carries the load to a predetermined wrap position within the packaging material dispensing path and the conveyor assembly stops leaving the load in a stationary position. A leading edge 257 of the packaging material 258 is held in a clamping assembly 262 located beneath the conveyor assembly 214 as seen in FIGS. 10 and 11. After at least one wrap has been made around the load 224 and the clamp assembly 262, the clamps are rotated releasing edge 257 which is held by the web wrap. If the wrap is for a full web load or a banded load, a plurality of overlying layers of packaging material are wrapped around the load and the conveyor assembly 214. In the spiral wrap mode, a plural number of wraps are wrapped around the downstream end of the load 224 in the same manner as the banding and the conveyor assembly is activated carrying the load downstream to a takeoff conveyor so that a spiral wrap is formed around the load. When the load 224 reaches a station where the end is sensed by a feeler gauge, light sensing means, pressure sensor switch or other suitable sensing mechanism, both the takeoff conveyor 220 and the wrapping conveyor assembly 214 stop and a second band is placed around the upstream end of the load 224 in the same manner as if a band or full web wrap were being wrapping around the load 224.

As and after the load 224 is wrapped, the load 224 is conveyed toward takeoff conveyor 220. The load 224 is carried on the top load supporting and conveying surface 292, and as the load 224 moves, the packaging material 258 wrapped about the load 258 and wrapping conveyor 214 moves with it. The packaging material 258 is moved along the non-driven rollers 294*a*, 294*b* and packaging material support guard 295 of the bottom packaging material transporting surface 294 by movement of the top load supporting and conveying surface 292. The angle of the non-driven rollers 294*a*, 294*b* and the packaging material support guard 295 ensures little friction between the packaging material 258 and the packaging material support guard 295 and prevents the packaging material from becoming lodged between the non-driven rollers 294*a*, 294*b* of the bottom packaging material transporting surface 294.

It should be noted that there is space between the conveyor assembly 214 and the takeoff conveyor 220 allowing the stretched packaging material web 258, which has been stretched by either a braking system or by a prestretching mechanism, to be discharged from the conveyor assembly 214 and assume its memory position M around the load 224.

It will be apparent to those skilled in the art that various modifications and variations can be made in the present invention without departing from the spirit or scope of the invention. Thus, it is intended that the present invention cover all modifications and variations of this invention that come within the scope of the appended claims and their equivalents.

What is claimed is:

1. An apparatus for wrapping packaging material around a top and bottom of a load in a wrapping area, comprising:

a cantilevered packaging material dispenser with a free end extending from an arm rotatable about a generally horizontal axis to wrap packaging material around the load and a packaging material transporting surface in the wrapping area; and a cantilevered load support surface with a free end mounted and movable in the wrapping area between a wrapping position and a load transfer position;

wherein the packaging material transporting surface is positioned below the cantilevered load support surface and is formed by non-driven rollers aligned in an inline configuration.

2. The apparatus of claim 1, wherein the non-driven rollers are mounted to a rail adjacent to and below the cantilevered load support surface.

3. The apparatus of claim 1, further including a packaging material support guard, said packaging material support guard bridging gaps between the inline rollers, thereby preventing capture of packaging material between said rollers.

4. The apparatus of claim 1, wherein the non-driven rollers are mounted to a rail adjacent to and below the cantilevered load support surface, and further including a packaging material support guard, said packaging material support guard bridging gaps between the inline rollers, thereby preventing capture of packaging material between said rollers, the packaging material support guard being mounted adjacent to a side of the non-driven rollers distal from the rail.

5. The apparatus of claim 1, further including a packaging material support guard, said packaging material support guard bridging gaps between the inline rollers, thereby preventing capture of packaging material between said rollers, wherein the packaging material support guard covers between 75% and 95% of outer surfaces of the non-driven rollers.

6. The apparatus of claim 5, wherein the packaging material support guard covers between 88% and 94% of the outer surfaces of the non-driven rollers.

7. The apparatus of claim 5, wherein the packaging material support guard covers approximately 75% of the outer surfaces of the non-driven rollers.

8. The apparatus of claim 6, wherein the packaging material support guard covers approximately 88% of the outer surfaces of the non-driven rollers.

9. The apparatus of claim 6, wherein the packaging material support guard covers approximately 94% of the outer surfaces of the non-driven rollers.

10. The apparatus of claim 1, further including last rollers laterally raised from a plane of the non-driven rollers and offset inward of the non-driven rollers.

11. The apparatus of claim 1, wherein the non-driven rollers are angled with respect to a plane perpendicular to the cantilevered load support surface.

12. The apparatus of claim 1, wherein the non-driven rollers are angled with respect to a plane perpendicular to the cantilevered load support surface, and wherein the rollers are angled between 10 degrees and 45 degrees.

13. The apparatus of claim 1, further including a packaging material support guard said packaging material support guard bridging gaps between the inline rollers, thereby preventing capture of packaging material between said rollers, wherein the support guard is clam shaped.

14. The apparatus of claim 1, further including a packaging material support guard, said packaging material support guard bridging gaps between the inline rollers, thereby preventing capture of packaging material between said rollers, wherein the support guard is treated with a material to minimize tacky film adhesion.

15. The apparatus of claim 1, wherein said non-driven rollers rotate as packaging material, wrapped around a load on a top surface of the cantilevered load support surface and around the packaging material transporting surface, is moved along the transporting surface as the wrapped load is removed from the cantilevered load support surface.

16. The apparatus of claim 1, wherein an upper surface of the cantilevered load support surface includes a conveyor.

17. The apparatus of claim 1, wherein an upper surface of the load support surface includes a powered load transporting surface.

18. The apparatus of claim 1, wherein an upper surface of the load support surface is a non-powered roller top surface.

19. The apparatus of claim 1, wherein the packaging material transporting surface includes two rows of inline non-driven rollers.

20. The apparatus of claim 1, wherein the packaging material transporting surface includes two rows of inline non-driven rollers, one below each side of the cantilevered load support surface.

21. The apparatus of claim 1, wherein the packaging material transporting surface includes two outer rows of angled, inline non-driven rollers, and two inner rows of inline non-driven rollers.

22. The apparatus of claim 1, wherein the packaging material support guard is attached to an outer surface of said non-driven rollers, and is formed in a clam shell shape to cover screws used to fasten the rollers.

23. The apparatus of claim 1, wherein the non-driven rollers are positioned to contact and carry at least a portion of the packaging material.

* * * * *

UNITED STATES PATENT AND TRADEMARK OFFICE

CERTIFICATE OF CORRECTION

PATENT NO. : 6,425,228 B2
DATED : July 30, 2002
INVENTOR(S) : Lancaster, III et al.

It is certified that error appears in the above-identified patent and that said Letters Patent is hereby corrected as shown below:

Title page,
Item [73], Assignees, change "Manangement" to -- Management --.

Signed and Sealed this

First Day of October, 2002

*Attest:*

*Attesting Officer*

JAMES E. ROGAN
*Director of the United States Patent and Trademark Office*